US005101706A

United States Patent [19]

Kilgore

[11] Patent Number: 5,101,706

[45] Date of Patent: Apr. 7, 1992

[54] HARMONIC BRIDGE

[76] Inventor: Robert D. Kilgore, 34 Hanover St., Glen Rock, Pa. 17327

[21] Appl. No.: 468,289

[22] Filed: Jan. 22, 1990

[51] Int. Cl.[5] ..... G10D 3/00

[52] U.S. Cl. ..... 84/318

[58] Field of Search ..... 84/315, 316, 317, 318

[56] References Cited

U.S. PATENT DOCUMENTS

| | | | |
|---|---|---|---|
| 514,263 | 2/1894 | Filstrup | 84/318 |
| 4,183,279 | 1/1980 | Shabram, Jr. | 84/318 |
| 4,334,457 | 6/1982 | Spoonts, III | 84/318 |
| 4,503,747 | 3/1985 | Labbe | 84/318 |
| 4,621,558 | 11/1986 | Cornette | 84/318 |
| 4,753,147 | 6/1988 | Berardi | 84/318 X |

FOREIGN PATENT DOCUMENTS

| | | | |
|---|---|---|---|
| 1048545 | 11/1966 | United Kingdom | 84/318 |

*Primary Examiner*—E. T. Hix
*Assistant Examiner*—Howard B. Blankenship
*Attorney, Agent, or Firm*—Charles J. Long

[57] ABSTRACT

A harmonic bridge for use with guitars and other string instruments having fretted fingerboards includes a frame above the strings and transverse to the fingerboard in a position directly over a fret. A string contacting member is mounted in the frame above a string. Height adjustment, of the frame supports or/and of the string contacting member with respect to the frame, is provided so that the lower surface of the string contacting member can be caused to depress the string by an amount just sufficient to stop string vibration at the contact point when the string is plucked, but not far enough to cause the string to touch the fret or fingerboard.

15 Claims, 3 Drawing Sheets

Fig. 10
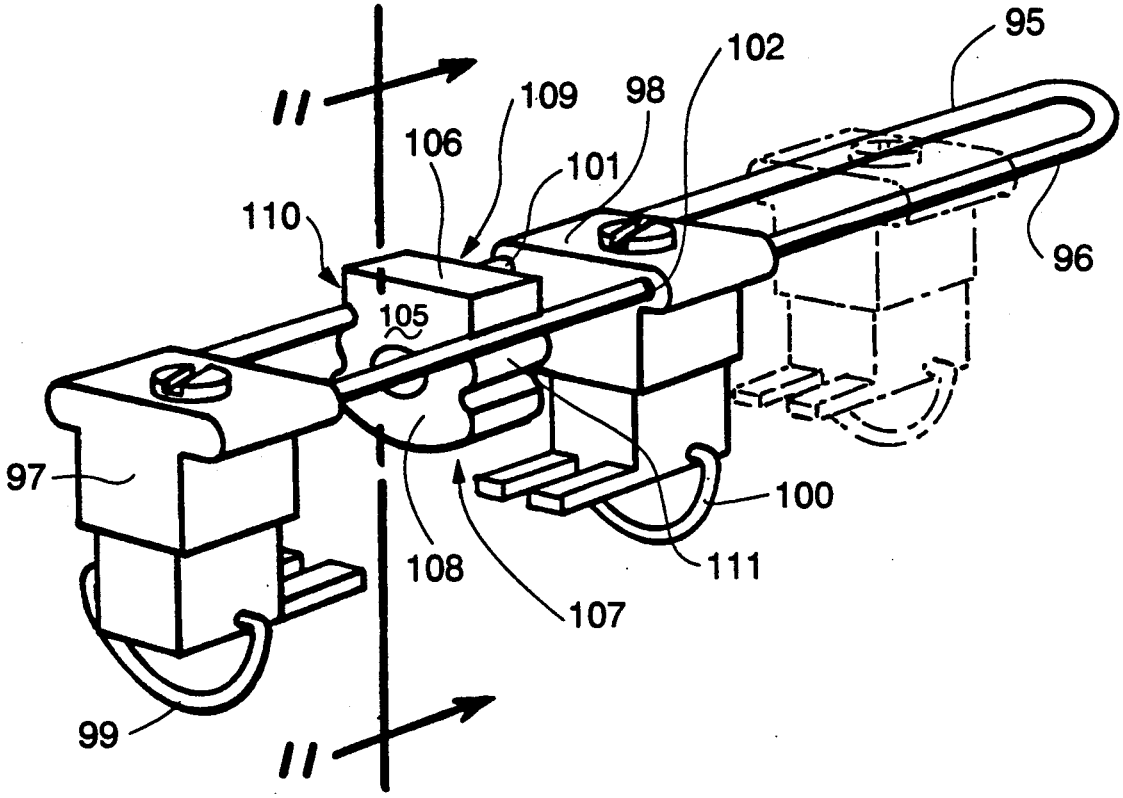
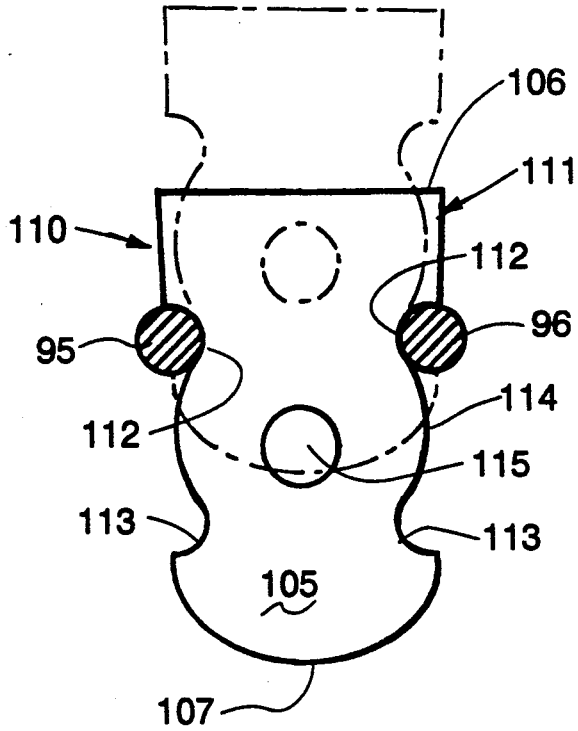
Fig. 11

HARMONIC BRIDGE

BACKGROUND OF THE INVENTION

1. Field of the Invention

This invention relates to stringed musical instruments having fretted fingerboards, such as guitars. More particularly, the invention relates to a device for allowing harmonic tones to be played on selected strings of such instruments without the need for the player to use his or her chording hand.

Instruments of the type with which my invention is used, such as guitars, include a body from which extends an elongated neck. The top surface of the neck comprises a fingerboard to which is fastened a series of parallel transverse raised ribs, or frets, spaced along its length At the outer end of the fingerboard is mounted a transverse bar generally called the "nut"; a second transverse bar, generally called the "saddle bridge", is mounted near the end of the body opposite the neck. A number of more or less parallel tone-producing strings under tension have their ends attached respectively to the body of the instrument and to tensioning pegs near the end of the neck; between the fastening points, each string passes over the nut and the saddle bridge of the instrument. The nut and saddle bridge serve both to support the strings at a small distance above the frets and to define the so-called "open" string length—i.e. the distance, between nut and saddle bridge, over which a plucked string is free to vibrate when otherwise untouched.

The pitch produced by a string can be changed by changing either the string's tension (more tension raises the pitch) or its effective length (shorter effective length raises the pitch); the former is obviously impracticable when playing the instrument, so effective length changes are used by players to play melodies or chords.

The most common way to change a string's effective length, which I will call "standard fingering" herein, is by the player using his or her finger to press the string firmly against the fingerboard between frets, which causes the string to bear on the adjacent fret nearest the saddle bridge of the instrument. Such contact with the fret shortens the vibrating length (or effective length) of the string, resulting in a higher pitch.

A second method of changing effective string length, which I will call "harmonic fingering" herein, is based on the fact that lightly touching a string at certain defined harmonic points will cause it to vibrate at a multiple of its open frequency. In harmonic fingering, the contact must be sufficient to stop vibration at the contact point but light enough that the string is not caused to contact either a fret or the fingerboard; optimum effectiveness is achieved when pressure on the string is the minimum required to stop vibration. For example, touching the string thus at the mid-point of its effective length will raise the produced pitch by one octave; although standard fingering causing an equivalent shortening of the effective length would result in the same rise in pitch, the tone quality produced by harmonic fingering is distinctly different from, and frequently preferred to, that produced by standard fingering. With a normal fretted fingerboard, the commonly-used harmonic points are located directly above frets.

The differences between standard fingering and harmonic fingering can be summarized as follows; standard fingering requires the string to be pressed tightly against the fingerboard between frets, so that the string firmly contacts the adjacent fret; in contrast, harmonic fingering requires minimal touching of the string, typically directly over a fret, and precludes string contact with either a fret or the fingerboard.

2. Description of the Prior Art

The prior art is replete with examples of capos, devices which shorten the effective string length by the mechanical equivalent of standard fingering. A typical capo consists of a laterally-oriented bar spanning all the strings, and fastening means, frequently a strap, which pass under the neck and attach to the ends of the bar, for holding the bar down so that it holds the strings tightly against the fingerboard. Most capos are removable and can be positioned anywhere along the neck of the instrument. The principal use of a capo is to raise the pitch of all the strings by the same amount, so that a player can play the instrument in different keys using the same finger positions relative to the capo as are used relative to the nut when the capo is not in place. Instead of a single bar, some capos include a plurality of adjacent elements mounted in a string-spanning support member, with each element adapted to hold down an individual string. It should be noted that because of the way a capo functions, when a string is held down by a capo, the portion of that string between the capo and the nut is musically useless—i.e, plucking or fingering that portion produces only odd sounds which have no resonance or tone quality. Some examples of prior art capos are shown in the following listed patents:

U.S. Pat. No. 514,263—bar operates on all strings

U.S. Pat. No. 4,503,747—bar operates on all strings

U.S. Pat. No. 4,621,558—bar operates on all strings

U.S. Pat. No. 4,183,279—separate element for each string

U.S. Pat. No. 4,334,457—separate element for each string

British Patent No. 1,048,545 separate element for each string

Regardless of how they are constructed, however, all capos are designed and intended for mounting on the fingerboard between frets and for holding one or more strings against the fingerboard as in standard fingering.

SUMMARY OF THE INVENTION

I have found that unique and desirable musical effects can be achieved if one or more strings is contacted as in harmonic fingering by mechanical means which I call a "harmonic bridge". Principal among these effects is that when a string is depressed by the harmonic bridge by only the minimum amount necessary to cause the harmonic effect, the string can still be played using standard fingering over its full open length, since manually depressing the string against the fingerboard in the portion between the harmonic bridge and the nut moves the string slightly out of contact with the harmonic bridge and thereby allows it to vibrate as it would were the harmonic bridge not in place.

In accordance with the invention, I provide, for use with a stringed instrument having a plurality of substantially parallel stretched strings above and spaced from a fretted fingerboard, a harmonic bridge comprising an elongated frame member of a length at least sufficient to laterally span the fingerboard, means for mounting the frame member on the fingerboard directly above a fret, string contacting means supported by the frame member, and means for causing the string contacting means to contact at least one string and depress the string by an amount at least sufficient to prevent vibration of the string at the contact point when the string is plucked, but less than that required to cause the string to touch the fret or fingerboard.

In a preferred embodiment, the frame member comprises a generally U-shaped channel and the mounting means comprises support columns at each end of the U-shaped channel extending generally perpendicular thereto in a direction away from the open side thereof, a bi-forked foot at the end of each support column away from the frame member, each foot being generally perpendicular to its column and extending inwardly toward the other foot, the space between forks in each foot being slightly wider than the width of the fret, the length of the forks being such that the forks rest on the fingerboard when the bridge is mounted thereon, and means for holding the feet against the fingerboard in a position straddling the fret, whereby when the bridge is mounted on the fingerboard, the frame member will be positioned over the fret. Preferably the support columns are so constructed as to be adjustable in height and include means for adjusting the height thereof. In this embodiment, the string contacting means preferably comprise at least one insert removably supported in the U-shaped channel and adapted to be positioned along the channel's length over a string to be contacted. The insert and U-shaped channel may be so configured that the depth of the insert in the channel can be adjusted.

In an embodiment of my invention adapted for use with fingerboards of different widths, the U-shaped channel frame member comprises two sections, one telescoped within the other, whereby the length of the channel can be varied to accommodate different fingerboard widths.

In another embodiment, the harmonic bridge of my invention includes a string contacting member mounted on the frame member for positioning therealong over a string to be contacted, the string contacting member including a string contacting pad which faces the string when the frame is mounted on the fingerboard. In this embodiment, the string contacting member may also include means for adjusting the position of the string contacting pad with respect to the string, whereby the pad can be extended to contact the string.

In an especially preferred embodiment, the frame member comprises two spaced apart substantially parallel straight rod portions and the mounting means comprise first and second support columns attached to the rod portions and generally perpendicular thereto, the support columns being separated by a distance at least equal to the fingerboard width; a bi-forked foot at the end of each support column away from the frame member, each foot being generally parallel to the rod portions and extending inwardly toward the other foot, the space between forks in each foot being slightly wider than the width of the fret, the length of the forks being such that the forks rest on the fingerboard when the bridge is mounted thereon; and means for holding the feet against the fingerboard in a position straddling the fret, whereby when the bridge is mounted on the fingerboard, the frame member will be positioned over the fret. Preferably the support columns are so constructed as to be adjustable in height and include means for adjusting the height thereof. For ease in manufacture, the frame member may be formed by bending a single length of rod into a "U" shape, the sides of the "U" constituting the rod portions. For adaptability to different fingerboard widths, the first support column may be fixedly attached to the rod portions and the second support column slidably attached thereto, whereby the position of the second support column on the rod portions can be changed to accommodate different fingerboard widths. In this embodiment, the string contacting means may comprise at least one insert removably supported between the two rod portions and adapted to be positioned over a string to be contacted. For further versatility, the insert may be fabricated of flexible material and so shaped that it can be readily moved between a first position in which it contacts the string and a second position in which it is spaced from the string, being supported between the rod portions in both the first and second positions.

I also provide a method of playing a stringed instrument having a body, a neck extending from the body to an outboard end, a fretted fingerboard mounted on the neck, and a plurality of strings stretched between a nut at the outboard end of the neck and a saddle bridge on the body, said strings being above and spaced from the fretted fingerboard, comprising mounting a string contacting member above a string in such position that it depresses the string by an amount just sufficient to stop string vibration at the point of contact when the string is plucked.

Other details, objects and advantages of the invention will become apparent as the following description of certain present preferred embodiments thereof proceeds.

BRIEF DESCRIPTION OF THE DRAWING

In the accompanying drawings I have shown certain present preferred embodiments of the invention in which:

FIG. 10 is a perspective view of an especially preferred embodiment of the invention in which the frame member comprises a U-shaped rod form and one of the two support columns is slidable to accommodate different fingerboard widths; and FIG. 11 is a view-taken along line 11—11 of FIG. 10, showing the cross-sectional shape and two-position adjustability of the string con-acting insert.

DESCRIPTION OF THE PREFERRED EMBODIMENTS

Figure 1:
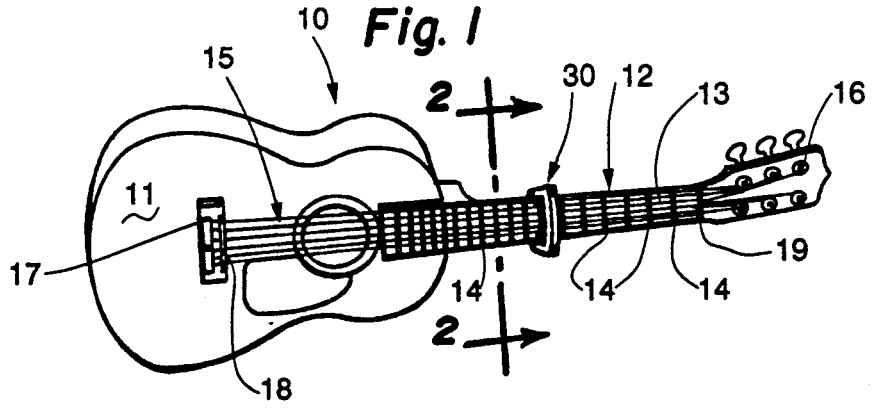
FIG. 1 is a perspective view of a guitar with a harmonic bridge of the invention mounted on the neck.

Turning first to FIGS. 1-5, there is shown a guitar 10 having a body 11 and a neck 12 extending from the body. A fingerboard 13 is mounted on the neck and extends for some length onto the body 11, and a series of transverse frets 14 are fastened to the fingerboard over its length. Six strings 15 are fastened at one end to rotationally adjustable turning pegs 16 at the end of neck 12; the other ends of strings 15 are secured to a clamping member 17 mounted on the body 11 of guitar 10. The strings pass over a saddle bridge 18 adjacent to the clamping member 17 and also over a nut 19 near the turning pegs 16. Rotation of pegs 16 causes the strings to be stretched to desired tensions between nut 19 and saddle bridge 18; the amount of tension on each string determines the "open" pitch of the string—i.e., the pitch it will sound when plucked while contacting only the nut and saddle bridge.

Mounted on fingerboard 13 is a harmonic bridge 30 according to the invention. In the embodiment shown, the harmonic bridge comprises an elongated frame 31 in the form of a generally U-shaped channel (seen in FIG. 3) which spans the width of fingerboard 13. At the ends of frame 31 two support columns 32 extend toward the fingerboard and terminate in inwardly-extending bi-forked feet 33. A lower portion 34 of each support column is telescoped within an upper portion 35 and the column height is adjustable by means of a screw 36 which passes through a hole in the top surface of upper portion 35 and engages a threaded hole 37 in lower portion 34. A coil spring 38 urges lower portion 34 away from upper portion 35 and serves to maintain pressure between the threads of screw 36 and the mating surfaces of hole 37 so as to resist turning of screw 36 after the desired column height has been set.

Bi-forked feet 33 at the lower end of columns 32 extend inwardly past the sides of the fingerboard 13 to support the harmonic bridge on the fingerboard. The space between the forks on each foot 33 is slightly wider than the width of the instrument fret, 14*a* in FIG. 5, and is deep enough that the foot can slip down over the end of the fret and rest on the fingerboard, thereby insuring that the harmonic bridge is positioned directly over the fret.

An elastic band 39 is stretched under the neck 12 of the guitar and has its ends looped around hooks 39*a* on the ends of the columns 32, to hold the harmonic bridge feet 33 down against fingerboard 13. The ends of band 39 can be removed from one or both hooks 39*a* to enable removal or repositioning of the harmonic bridge.

Figure 2:
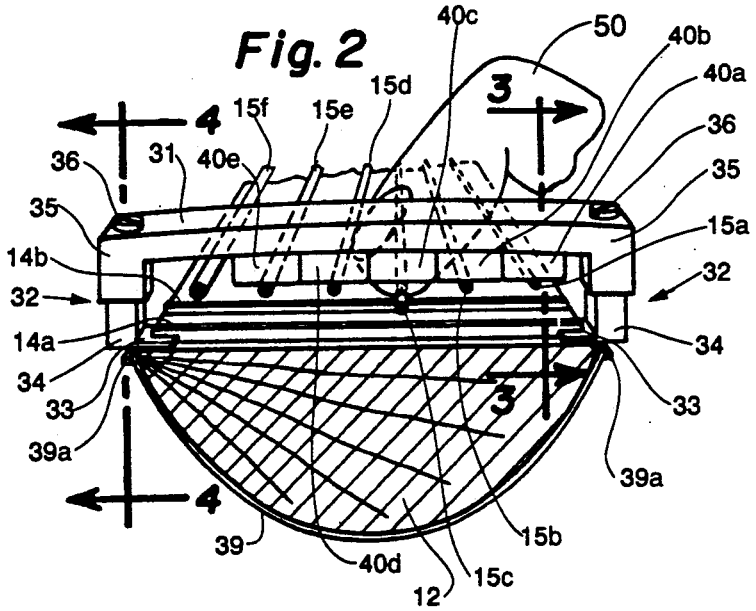
FIG. 2 is a cross-sectional view taken along line 2-2 of FIG. 1 and showing string-contacting inserts of the harmonic bridge over five of the six guitar strings, with four strings in contact with the inserts and the fifth, in the center, depressed away from its insert by a player's finger positioned between the harmonic bridge and the nut of the guitar.
Figure 3:
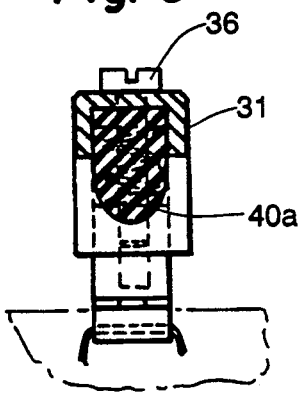
FIG. 3 is a view taken along line 3—3 of FIG. 2 and illustrating the U-shaped frame and a string-contacting insert held
Figure 4:
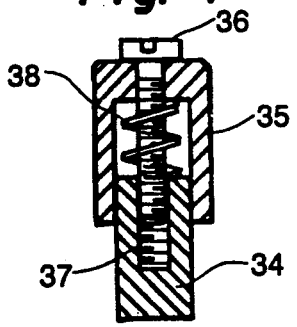
FIG. 4 is a cross-sectional view taken along line 4—4 of FIG. and the height adjustment of one of the supporting columns of the harmonic bridge.

Removable string contacting inserts 40*a*–40*f*, sometimes referred to generally as 40, made of rubber or similar material can be inserted in the U-shaped frame above the string or strings to be contacted; as indicated in FIG. 3, each insert is held in place by friction with the channel walls. In FIG. 2, inserts 40*a*–40*e* are in place to contact strings 15*a*–15*e* respectively, and in FIG. 5, inserts 40*b* and 40*d*–40*f* are in place to contact strings 15*b* and 15*b*–15*f* respectively. It should be understood that the specific string or strings to be contacted are a matter of choice by the player, determined by the particular musical effects desired; in that regard, although my harmonic bridge can be constructed with a single and/or permanent string-contacting member, wide enough to contact all or perhaps all but one of the strings, the versatility of the invention is greatly enhanced by providing a separate removable contact insert for each string.

In use, the harmonic bridge of FIGS. 1 through 5 functions as follows:

First, the player determines which strings are to be contacted and places a contact insert in the frame in the position corresponding to each such string. The harmonic bridge is then placed on the fingerboard with its feet straddling the fret located beneath the desired harmonic point of the strings, and the elastic band 39 is stretched under the neck of the instrument and looped over the hooks 39*a*. Finally, the heights of support columns 32 are adjusted using screws 36 until the inserts 40 contact the strings beneath them with the minimum pressure necessary to cause the harmonic effect, as above discussed. As shown in FIG. 2, the diameter of individual strings normally increases in progressing from the highest-pitched string to the lowest-pitched string; consequently, it generally happens that the two support columns 32 must be set at different heights for optimum effectiveness of the harmonic bridge. With the harmonic bridge in place, plucking of a contacted strin a point between the harmonic bridge and the saddle bridge 18 will cause a string to sound at its harmonic pitch provided no other contact is made with that string. Obviously also, if the player presses a contacted string against the fingerboard between the harmonic bridge and the saddle bridge, the string will respond as though the bridge were not in place; however, an added important feature of the invention is illustrated for string 15*c* of FIG. 2. In that figure, the player's finger 50 has pressed string 15*c* down against the fingerboard at a point outboard of the harmonic bridge—i.e., between the harmonic bridge and the nut 19. In FIG. 2, the finger has caused string 15*c* to contact fret 14*b* immediately behind the fret over which the harmonic bridge is mounted; as illustrated, such action moves string 15*c* out of contact with insert 40*c* so that when plucked, the string produces the same pitch it would produce were the harmonic bridge not in place. Many interesting effects are thus created when the harmonic bridge is in place and properly adjusted as to height; for example, the player can strum and finger the instrument in the normal way, but when he or she removes his or her finger from a string which is under a harmonic bridge contact member, the pitch will return to the harmonic note instead of to the open string note.

As will be appreciated by those skilled in the art, the harmonic bridge of my invention can be designed in various ways. Three such alternative designs are shown in FIGS. 6 and 7, FIGS. 8 and 9, and FIGS. 10 and 11 respectively.

Figure 6:
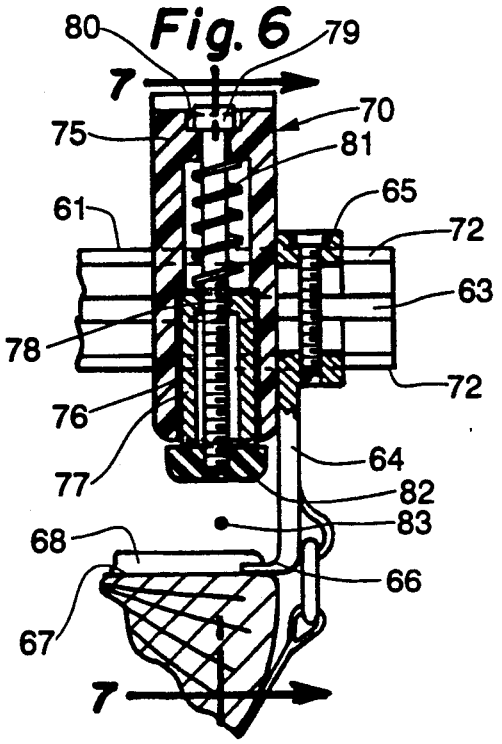
FIG. 6 is a view partially in cross-section of another embodiment of my harmonic bridge.
Figure 7:
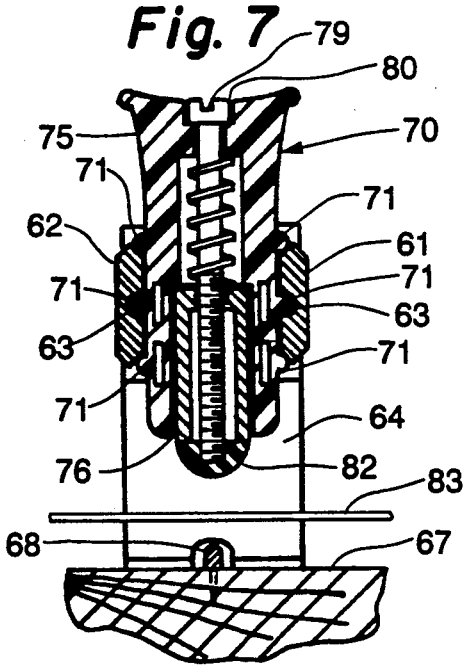
FIG. 7 is another cross-sectional view of the harmonic bridge of FIG. 6, taken along line 7—7 of FIG. 6.

FIGS. 6 and 7 show an embodiment of the invention in which the height of the support columns is fixed and the string-contacting members can be individually adjusted with respect to their distance below the frame member. Referring to FIGS. 6 and 7, in which only one string-contacting member is shown, the harmonic bridge includes a frame member which comprises two spaced-apart side beams 61, 62 each with a longitudinal groove 63 in its inner surface. The frame member is mounted on two support columns, only one of which 64 is shown, by means of screw-tightened clamping members 65. A biforked foot 66, similar to feet 33 of FIG. 2, extends inwardly at the bottom of each support column and rests on fingerboard 67 with fret 68 between its forks. String-contacting member 70 is held between side beams 61, 62 of the frame; vertical support for member 70 is provided by protrusions 71 on the sides of the member which engage the longitudinal grooves 63 of the side beams as well as beveled surfaces 72 at the top and bottom of each side beam, and lateral position is maintained by friction between the member 70 and the sidewalls 61, 62. In this version of the harmonic bridge, string-contacting member 70 includes a housing 75 having a bore 76 of square cross-section in its lower end. A hollow insert 77 received in bore 76 has a threaded hole 78 through its end. A screw 79 having its head bearing against the shoulder of a hole 80 in the top of housing 75 is threaded into hole 78, and a coil spring 81 urges insert 77 in the direction out of the bore 76. Attached to the bottom of insert 77 is a pad 82 made of rubber or similar material and having a downwardly convex bottom surface in the shape of a segment of a cylinder, the axis of which is parallel to fret 68. In using this embodiment of my harmonic bridge, string-contacting member 70 is positioned along side beams 61, 62 over the string 83 to be contacted. Screw 79 is then turned counter-clockwise, causing insert 77 to move out of the bore 76, until pad 82 makes the desired contact with string 83. Similar positioning and adjustment is done for each string-contacting member utilized with this embodiment. An added feature of the embodiment of FIGS. 6 and 7 is that the clamping members 65 on support columns 64 can be loosened to allow the lateral position of the support columns to be adjusted with respect to the frame member so that fingerboards of different widths can be accommodated.

Figure 8:
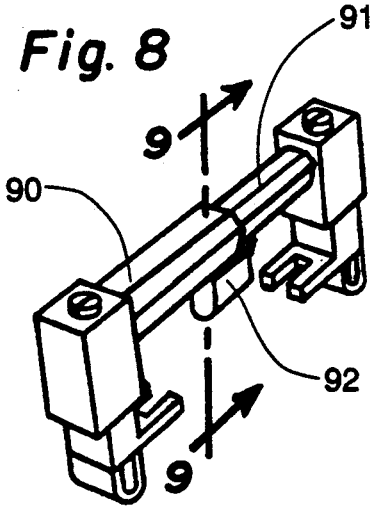
FIG. 8 is a perspective view of a third embodiment of the invention showing a telescoping frame member especially adapted for use with finger boards of different widths.
Figure 9:
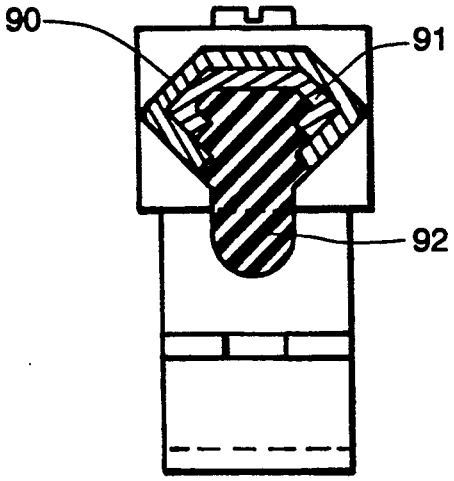
FIG. 9 is a cross-sectional view of the embodiment of FIG. 8, taken along line 9—9 of FIG. 8.

FIGS. 8 and 9 show another embodiment of my harmonic bridge which is well suited for use on fingerboards of different widths. The overall construction of this embodiment is similar to that of FIGS. 1 through 5, with two principal differences: First, the frame member consists of two generally hexagonal U-shaped channel sections 90 and 91 having equal width openings at their lower sides, with section 91 slidably telescoped within section 90; this construction allows the frame length to be increased or decreased as necessary to fit different fingerboard widths. Second, the cross-section of the upper portion of string-contacting insert 92 includes sawtooth-like contours shaped to snugly conform to the interior space formed when section 91 is within section 90; with the contour illustrated, it will be seen that insert 92 is held in position at any point along the length of the frame member, whether section 90 alone, section 91 alone, or both sections are present at that point.

The embodiment of the invention shown in FIGS. 10 and 11 is easy to fabricate and especially adaptable for different fingerboard widths. It includes a frame member which comprises two spaced apart substantially parallel straight rod portions 95 and 96; although two separate pieces of rod can be used for this frame member, I have found it convenient to form the member by bending a single length of rod, for example brass rod, into a "U" shape, with the sides of the "U" forming the straight rod portions 95 and 96.

First and second support columns 97 and 98 are attached to the rod portions 95 and 96. The basic construction of support columns 97 and 98 is like that of columns 32 of FIGS. 2, 4 and 5—i.e., they are telescopically height-adjustable and include inwardly extending bi-forked feet at their lower ends. Rings 99 and 100 are attached to the bottoms of columns 97 and 98 respectively for engaging the ends of an elastic band or the like which holds the bridge against the fingerboard as does band 39 in FIGS. 2 and 5. Support column 97 is fixedly attached to the ends of rod portions 95 and 96. Support column 98, however, is slidably attached to the rod portions; as indicated in FIG. 10, the rod portions pass through closely fitting holes 101 and 102 formed in the upper section of support column 98. The size of holes 101 and 102 in relation to the rod size is preferably such as to create some friction between the rods and the support columns but still allow the support column to be easily slid to different portions, for example, the position shown by hatched lines in FIG. 10. The mobility of support column 98 allows rapid adjustment of the harmonic bridge to fit different fingerboard widths; this is especially helpful in cases where a player wishes to shift the position of the harmonic bridge on a fingerboard which changes in width along its length, as many do. I have also found that when the embodiment of FIG. 10 is secured in place by an elastic band stretched from loop 99 to loop 100 under the instrument neck, there is no tendency for support column 98 to move from its proper position.

The harmonic bridge of FIGS. 10 and 11 includes a string contacting insert 105 of a particularly useful design, illustrated most clearly in FIG. 11. The insert is fabricated of flexible material such as rubber and has a rectangular planar top surface 106 and a downwardly convex bottom surface 107 of the same general shape as that of pad 82 in FIGS. 6 and 7. Two planar opposite sides 108 and 109 are perpendicular to rod portions 95 and 96 and the other two sides 110 and 111 are parallel to the rod portions. As shown in FIG. 11, sides 110 and 111 are shaped to form upper and lower opposed pairs of transverse grooves 112 and 113 for engaging the frame member rod portions 95 and 96 and thereby providing raised and lowered support positions for the insert. A rounded wider section 114 between upper and lower grooves is readily compressible by virtue of a transverse hole 115 formed through the insert, which makes it possible for a player to shift the insert between the lowered position, shown in solid lines in FIG. 11, and the raised position, shown in hatched lines, while the harmonic bridge is in place on the fingerboard.

With a full set of inserts—i.e., one above each string—the embodiment of FIGS. 10 and 11 can be set by height adjustment of the support columns so that all strings are properly contacted when the inserts are in the lowered positions. The player can then move to the raised position any insert over a string not to be contacted; if a different string contact arrangement is desired later in the piece or program, the player can simply shift inserts as necessary into or out of contact with the strings without moving the harmonic bridge itself. Such versatility is, of course, a highly desirable feature of this embodiment.

Although the foregoing description of preferred embodiments of the invention has generally been with reference to the typical acoustic guitar shape shown in FIG. 1, i.e. including a sound amplifying hourglass-shaped body from which the neck extends, it will be appreciated by those familiar with the art that in many guitars, particularly electric guitars, the body takes widely varying shapes, sometimes amounting to a little more than an extension of the neck. It should be noted that the harmonic bridge of my invention is useful with all such instruments, provided only that they have fretted fingerboards.

While I have shown and described certain present preferred embodiments of the invention, it is to be distinctly understood that the invention is not limited thereto but may be otherwise variously embodied within the scope of the following claims.

I claim:

1. For use with a stringed instrument having a plurality of stretched strings above and spaced from a fretted fingerboard, a harmonic bridge comprising:

an elongated frame member of a length at least sufficient to laterally span the fingerboard;

means connected to the frame member and so constructed and arranged as to rest on the fingerboard and support the frame member directly above a fret;

string contacting means supported by the frame member; and means for causing the string contacting means to contact one string at a contact point and depress the string by an amount at least sufficient to prevent vibration of the string at the contact point when the string is plucked, but less than the amount required to cause the string to touch the fret or the fingerboard.

2. For use with a stringed instrument having a plurality of stretched strings above and spaced from a fretted fingerboard, a harmonic bridge comprising:

an elongated frame member of a length at least sufficient to laterally span the fingerboard;

means for mounting the frame member on the fingerboard directly above a fret;

string contacting means supported by the frame member, including a string contacting member mounted on the frame member and moveable therealong for positioning over one of said strings to be contacted, said string contacting member including a string contacting pad which faces the string when the frame is mounted on the fingerboard; and means for causing the string contacting means to contact one string at a contact point and depress the string by an amount at least sufficient to prevent vibration of the string at the contact point when the string is plucked, but less than the amount required to cause the string to touch the fret or the fingerboard.

3. A harmonic bridge as claimed in claim 2 wherein the string contacting member includes means for adjusting the position of the string contacting pad with respect to the string, whereby the pad can be extended to contact the string.

4. For use with a stringed instrument having a plurality of stretched strings above and spaced from a fretted fingerboard, a harmonic bridge comprising:

an elongated frame member of a length at least sufficient to laterally span the fingerboard, said frame member comprising two spaced apart substantially parallel straight rod portions;

means for mounting the frame member on the fingerboard directly above a fret, said mounting means comprising (a) first and second support columns attached to the rod portions and generally perpendicular thereto, each support column terminating in a distal end at a point away from the frame member, the support columns being separated by a distance at least equal to the fingerboard width; (b) a bi-forked foot at the distal end of each support column, each foot being generally parallel to the rod portions and extending inwardly toward the other foot, the space between forks in each foot being slightly wider than the width of the fret, the length of the forks being such that the forks rest on the fingerboard when the bridge is mounted thereon; and (c) means for holding the feet against the fingerboard in a position straddling the fret, whereby when the bridge is mounted on the fingerboard, the frame member will be positioned over the fret;

string contacting means supported by the frame member; and means for causing the string contacting means to contact at least one string and depress the string by an amount at least sufficient to prevent vibration of the string at the contact point when the string is plucked, but less than the amount required to cause the string to touch the fret or the fingerboard.

5. A harmonic bridge as claimed in claim 4 wherein the support columns are so constructed as to be adjustable in height and include means for adjusting the height thereof.

6. A harmonic bridge as claimed in claim 5 in which the frame member is formed by bending a single length of rod into a "U" shape, the sides of the "U" constituting the rod portions.

7. A harmonic bridge as claimed in any of claims 4, 10 or 11, wherein the first support column is fixedly attached to the rod portions and the second support column is slidably attached to the rod portions, whereby the position of the second support column on the rod portions can be changed to accommodate different fingerboard widths.

8. A harmonic bridge as claimed in claim 7 wherein the string contacting means comprise at least one insert removably supported between the two rod portions and adapted to be positioned over a string to be contacted.

9. A harmonic bridge as claimed in claim 8 wherein the insert is fabricated of flexible material and is so shaped that it can be readily moved between a first position in which it contacts the string and a second position in which it is spaced from the string, being supported between the rod portions in both the first and second positions.

10. For use with a stringed instrument having a plurality of stretched strings above and spaced from a fretted fingerboard, a harmonic bridge comprising:

an elongated frame member of a length at least sufficient to laterally span the fingerboard, the frame member comprising a generally U-shaped channel having an open side;

means for mounting the frame member on the fingerboard directly above a fret, comprising (a) support columns at each end of the U-shaped channel, each support column extending generally perpendicular to the channel in a direction away from the open side of the channel and terminating in a distal end at a point away from the channel,; (b) a bi-forked foot at the distal end of each support column, each foot being generally perpendicular to its column and extending inwardly toward the other foot, the space between forks in each foot being slightly wider than the width of the fret, the length of the forks being such that the forks rest on the fingerboard when the bridge is mounted thereon; and (c) means for holding the feet against the fingerboard in a position straddling the fret, whereby when the bridge is mounted on the fingerboard, the frame member will be positioned above the fret;

string contacting means supported by the frame member; and means for causing the string contacting means to contact at least one string at a contact point and depress the string by an amount at least sufficient to prevent vibration of the string at the contact point when the string is plucked, but less than the amount required to cause the string to touch the fret or the fingerboard.

11. A harmonic bridge as claimed in claim 10 wherein the support columns are so constructed as to be adjustable in height and include means for adjusting the height thereof.

12. A harmonic bridge as claimed in either of claims 10 or 11 wherein the string contacting means comprise at least one insert removably supported in the U-shaped channel and adapted to be positioned along the channel's length over a string to be contacted.

13. A harmonic bridge as claimed in claim 12 wherein the insert and U-shaped channel are so configured that the depth of the insert in the channel can be adjusted.

14. A harmonic bridge as claimed in either of claims 10 or 11 wherein the U-shaped channel comprises two sections, one telescoped within the other, whereby the length of the channel can be varied to accommodate different fingerboard widths.

15. A method of playing a stringed instrument having a body, a neck extending from the body to an outboard end, a fretted fingerboard mounted on the neck, and a plurality of strings stretched between a nut at the outboard end of the neck and a saddle bridge on the body, said strings being above and spaced from the fretted fingerboard, said method comprising mounting a string contacting member above a contact point on a predetermined one of said strings in such position that it depresses said predetermined string by an amount just sufficient to stop string vibration at said contact point when said string is plucked, said contact point being directly above a fret on said fingerboard, and plucking said string to produce a musical tone.

* * * * *

UNITED STATES PATENT AND TRADEMARK OFFICE

CERTIFICATE OF CORRECTION

PATENT NO. : 5,101,706

DATED : April 7, 1992

INVENTOR(S) : Robert D. Kilgore

It is certified that error appears in the above-identified patent and that said Letters Patent is hereby corrected as shown below:

Column 2, line 38, insert a dash before "separate."

Figure 5:
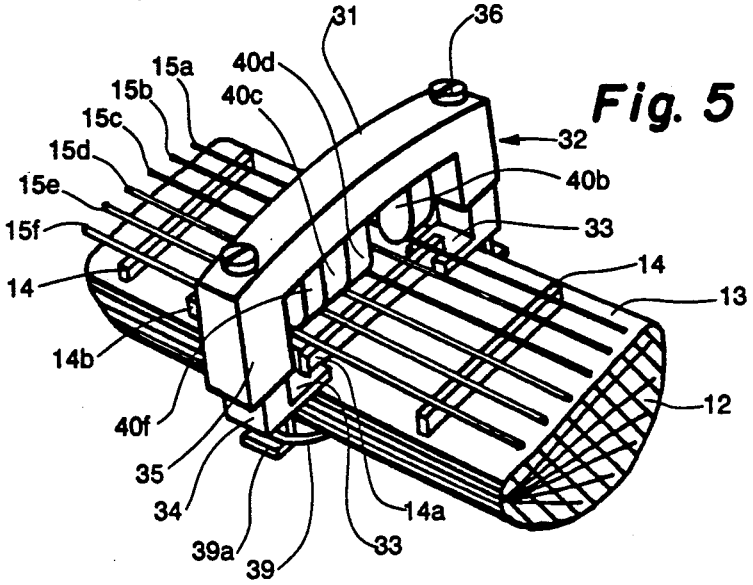
FIG. 5 is a close-up perspective view of a portion of the guitar FIG. 1 with the harmonic bridge mounted thereon, showing more clearly the bi-forked feet straddling the fret.

Column 4, line 44, begin a new paragraph with "Fig. 3..."
line 46, add --therein;-- after "held."
line 48, insert --. 2-- after "Fig."
line 48, insert --showing-- after "and."
line 49, begin a new paragraph with "Fig. 5..."
line 50, insert --neck of-- after "guitar."

Column 5, line 3, delete "conacting" and substitute --contacting-- therefor.

Column 6, line 25, delete "strin" and substitute --string at-- therefor.
line 67, delete "biforked" and substitute --bi-forked-- therefor.

Col. 10, line 26, delete "10" and substitute --5-- therefor.
line 27 (claim 7), delete "11" and substitute --6-- therefor.

Signed and Sealed this

Twenty-second Day of June, 1993

Attest:

Michael K. Kirk

MICHAEL K. KIRK

Attesting Officer

Acting Commissioner of Patents and Trademarks